United States Patent [19]

Kusumoto et al.

[11] Patent Number: 5,012,281

[45] Date of Patent: Apr. 30, 1991

[54] IMAGE FORMING APPARATUS HAVING A JAM COUNTER ADAPTED TO BE DISABLED UNTIL A READY FOR COPY STATE IS CONFIRMED

[75] Inventors: Keiji Kusumoto; Hirokazu Yamada; Hiroyuki Ideyama, all of Osaka, Japan

[73] Assignee: Minolta Camera Kabushiki Kaisha, Osaka, Japan

[21] Appl. No.: 224,142

[22] Filed: Jul. 26, 1988

[30] Foreign Application Priority Data

| | | | |
|---|---|---|---|
| Jul. 27, 1987 | [JP] | Japan | 62-188494 |
| Jul. 27, 1987 | [JP] | Japan | 62-1888495 |
| Jul. 27, 1987 | [JP] | Japan | 62-188496 |
| Sep. 14, 1987 | [JP] | Japan | 62-230456 |

[51] Int. Cl.[5] ..... G03G 21/00

[52] U.S. Cl. ..... 355/206; 355/204; 355/316

[58] Field of Search ..... 355/203, 204, 205, 206, 355/316, 317, 321, 308, 209, 208

[56] References Cited

U.S. PATENT DOCUMENTS

| | | | |
|---|---|---|---|
| 4,062,061 | 12/1977 | Batchelor et al. | 355/206 X |
| 4,133,477 | 1/1979 | Marino et al. | 355/209 X |
| 4,243,313 | 1/1981 | Masuda et al. | 355/206 |
| 4,260,904 | 4/1981 | Horie et al. . | |
| 4,511,241 | 4/1985 | Tsudaka et al. | 355/206 X |
| 4,668,075 | 5/1987 | Shigemura et al. | 355/206 |

FOREIGN PATENT DOCUMENTS

| | | |
|---|---|---|
| 0085975 | 8/1983 | European Pat. Off. . |
| 2090196A | 11/1981 | United Kingdom . |

*Primary Examiner*—A. T. Grimley
*Assistant Examiner*—William J. Royer
*Attorney, Agent, or Firm*—Burns, Doane, Swecker & Mathis

[57] ABSTRACT

An image forming apparatus including a sheet supply assembly capable of successively supplying sheet media, an image producing stage for producing an image on each of the sheet media supplied from a sheet supply, a sheet discharge roller for discharging from the image producing stage each of the sheet media each having an image produced thereon, sensors for detecting an occurrence of jamming of a sheet medium between the sheet supply and discharge assemblies, a jam counter operative to count the number of occurrences of jamming of the sheet medium, the jam counter being activated each time an occurrence of jamming is detected by any of the sensors, and a control circuit for monitoring the operational conditions of the image producing stage responsive to a sheet medium supplied from the sheet supply assembly after an occurrence of jamming of a sheet medium has been detected by any of the sensors, and disabling the jam counter depending on the monitored operational conditions of the image producing stage.

16 Claims, 10 Drawing Sheets

100
106
48
SENSOR
SPS1
PB0
PA0
(34)
FEED ROLLER
50
SENSOR
SPS2
PB1
PA1
(38)
TIMING ROLLER
80
SWITCH
FDR1
PB2
PA2
MAIN MOTOR
MD
68
SWITCH
(C/S)
PB3
66
52
SWITCH
SJR
PB4
72
INDICATOR
76
INDICATOR
82
SWITCH
FDR2
PB5
78
INDICATOR
OTHER INPUTS
μP
102
102a
1ST JAM COUNTER
2ND JAM COUNTER
102b
OTHER OUTPUTS
104

JAM COUNT
E01
JAMMING DETECTED
NO
YES
E02
CJM = 0
NO
YES
E03
1/1 - 1/3
E04
CJM ← 1
E05
CJM ← 2
E06'
READY FOR COPYING
NO
RETURN
YES
E07
CJM = 0/1/2
0
1
2
E09
E08
CJ1 ← CJ1 + 1
CJ2 ← CJ2 + 1
CJM ← 0
E10
RETURN

IMAGE FORMING APPARATUS HAVING A JAM COUNTER ADAPTED TO BE DISABLED UNTIL A READY FOR COPY STATE IS CONFIRMED

FIELD OF THE INVENTION

The present invention relates to an image forming apparatus such as a printer or a copier.

BACKGROUND OF THE INVENTION

In an ordinary image forming apparatus such as a printer or a copier, a print sheet is supplied and discharged along a prescribed path with any visible image reproduced thereon while the print sheet is travelling along the path. In an image forming apparatus of this type, a jamming of a print sheet may be caused at any location of the path along which the print sheet is to be transported until the sheet is to be discharged from the apparatus. A printer or a copier which is presently in use is therefore ordinarily equipped with means adapted to detect an occurrence of the jamming of a print sheet and bring the apparatus to a stop and/or display the occurrence of the jamming for warning to the operator.

Such means may include a jam counter which is operative to update its content each time an occurrence of jamming is detected and thus count the number of occurrences of the jamming detected. The content of such a jam counter provides helpful information to, for example, the serviceman who troubleshoots the apparatus for the purpose of remedying the jammed condition.

An image forming apparatus furnished with such a jam counter has however had an important drawback.

In the event jamming is caused in a printer or a copier, the operator of the apparatus will try to eliminate the jammed condition by removing the jammed print sheet out of the apparatus and then re-start the apparatus if he has successfully eliminated the jammed condition. There may however be a case where he could not visually recognize the jammed print sheet remaining within the apparatus and may thus re-start the apparatus with the jammed condition left therein. The jammed print sheet having failed to be removed out of the apparatus, an occurrence of jamming will be for a second time detected from the particular jammed print sheet during the cycle of operation thus re-started. The occurrence of the jamming caused during the previous cycle of operation will thus be counted as the occurrence of jamming caused during the current cycle of operation and accordingly the content of the jam counter will be incremented twice for one and the same occurrence of jamming. In this fashion, there occurs a discrepancy between the number of occurrences of the jamming actually caused and the number of occurrences of the jamming represented by the content of the jam counter. Such a discrepancy provides misleading information to the serviceman troubleshooting the apparatus.

The occurrences of the jamming detected in the past may be counted cumulatively with the content of the jam counter incremented without being reset. To facilitate the serviceman to troubleshoot the apparatus each time he is requested to attend an accident such as typically an occurrence of jamming, it will be more convenient for him to have the content of the jam counter reset to a certain initial state each time he has services the apparatus so that he is enabled to readily remedy the trouble when he attends the apparatus for a second time.

It is, accordingly, an important object of the present invention to provide an image forming apparatus equipped with an improved jam counter which is operative to update its content each time an occurrence of jamming is detected and thus count the number of occurrences of the jamming detected.

It is another important object of the present invention to provide an improved image forming apparatus in which the number of occurrences of the jamming represented by the content of a jam counter is at all times identical with the number of occurrences of the jamming actually caused after the content of the jam counter has been reset.

It is still another important object of the present invention to provide an improved image forming apparatus having a jam counter which will provide truly helpful information to, typically, the serviceman who troubleshoots the apparatus for the purpose of remedying a jammed condition.

Yet, it is still another important object of the present invention to provide an improved image forming apparatus having a jam counter the content of which is to be reset to a certain initial state each time the apparatus is serviced.

SUMMARY OF THE INVENTION

In accordance with an outstanding aspect of the present invention, there is provided an image forming apparatus which comprises (a) image producing means for producing an image on a sheet medium, the image producing means comprising sheet supply means capable of successively supplying sheet media, an image producing stage for producing an image on each of the sheet media supplied from the sheet supply means, sheet discharge means for discharging from the image producing stage each of the sheet media each having an image produced thereon, (b) detecting means for detecting an occurrence of jamming of a sheet medium between the sheet supply means and the sheet discharge means, (c) a jam counter operative to count the number of occurrences of jamming of the sheet medium, the jam counter being activated each time an occurrence of jamming is detected by the detecting means, and (d) control means for monitoring the operational conditions of the image producing means responsive to a sheet medium supplied from the sheet supply means after an occurrence of jamming of a sheet medium has been detected by the detecting means, and disabling the jam counter depending on the monitored operational conditions of the image producing means.

The control means included in an image forming apparatus according to the present invention is preferably operative to disable the jam counter until a new sheet medium is supplied from the sheet supply means after an occurrence of jamming of a sheet medium has been detected by the detecting means. In this instance, the control means of the image forming apparatus may comprise a status counter adapted to increment its content in response to a sheet medium supplied by the sheet supply means and decrement its content in response to a sheet medium discharged by the sheet supply means, the control means being operative to disable the jam counter depending on the content of the status counter. Such an image forming apparatus may further comprise display means for displaying a numerical value corresponding to the content of the jam counter, and switch means for resetting the content of the jam counter to a predetermined initial state.

Alternatively, the control means of an image forming apparatus according to the present invention may be operative to disable the jam counter until a new sheet medium is discharged by the sheet discharge means after an occurrence of jamming of a sheet medium has been detected by the detecting means. In this instance, the image forming apparatus according to the present invention may also further comprise display means for displaying a numerical value corresponding to the content of the jam counter, and switch means for resetting the content of the jam counter to a predetermined initial state.

In accordance with another outstanding aspect of the present invention, there is provided an image forming apparatus comprising (a) sheet supply means capable of successively supplying a plurality of sheet media, (b) image producing means for producing an image on each of the sheet media supplied from the sheet supply means, (c) sheet discharge means for discharging from the image producing means each of the sheet media each having an image reproduced thereon, (d) detecting means for detecting an occurrence of jamming of a sheet medium between the sheet supply means and the sheet discharge means, (e) a jam counter which is operative to count the number of occurrences of jamming of the sheet medium, and (f) control means which, when an occurrence of jamming of a sheet medium is detected by the detecting means, is operative to activate the jam counter after it is confirmed that a new sheet medium is supplied from the sheet supply means.

In accordance with still another outstanding aspect of the present invention, there is provided an image forming apparatus comprising (a) sheet supply means capable of successively supplying sheet media, (b) image producing means for producing an image on each of the sheet media supplied from the sheet supply means, (c) sheet discharge means for discharging from the image producing means each of the sheet media each having an image produced thereon, (d) detecting means for detecting an occurrence of jamming of a sheet medium between the sheet supply means and the sheet discharge means, (e) a jam counter operative to count the number of occurrences of jamming of the sheet medium, and (f) control means which, when an occurrence of jamming of a sheet medium is detected by the detecting means, is operative to activate the jam counter after it is confirmed that a sheet medium has been discharged by the sheet discharge means.

In accordance with still another outstanding aspect of the present invention, there is provided an image forming apparatus comprising (a) image producing means for transporting a sheet medium along a predetermined sheet transport path and producing an image on the sheet medium, (b) detecting means for detecting an occurrence of jamming of a sheet medium at any location of the predetermined sheet transport path, (c) counting means operative to count the number of occurrences of jamming of the sheet medium, the jam counter being activated each time an occurrence of jamming is detected by the detecting means, (d) display means for displaying a numerical value corresponding to the content of the counting means, and (e) switch means for resetting the content of the counting means to a predetermined initial state.

BRIEF DESCRIPTION OF THE DRAWINGS

The features and advantages of an image forming apparatus according to the present invention will be more clearly appreciated from the following description taken in conjunction with the accompanying drawings in which.

DESCRIPTION OF THE PREFERRED EMBODIMENT

Figure 1:
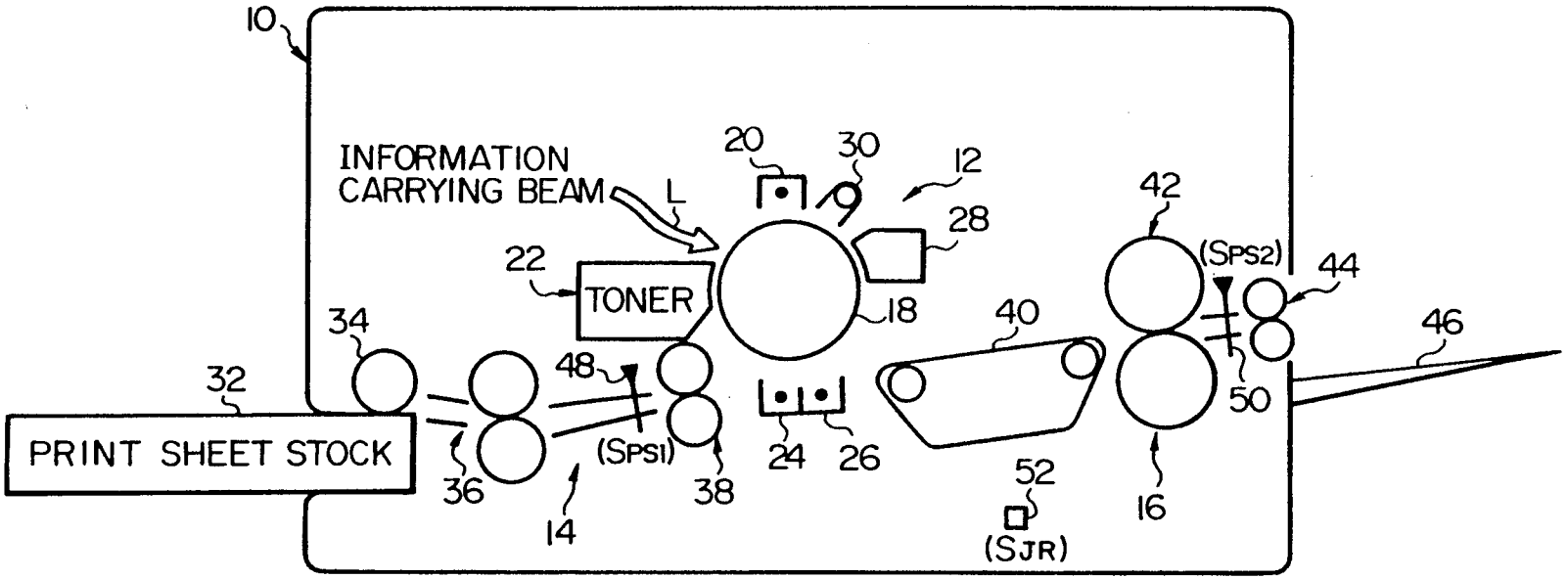
FIG. 1 is a schematic elevation view showing the general mechanical construction and arrangement of a preferred embodiment of an image duplicating apparatus according to the present invention.

As shown in FIG. 1, an image forming apparatus embodying the present invention comprises a housing 10 having an upper panel portion formed in part by a transparent document table (not shown). A sheet of document bearing images to be reproduced is to be placed on this document table so that, during copying operation of the apparatus, the document sheet placed on the document table is optically scanned by illumination with light from an optical scanning system incorporated in the housing 10, though not shown in the drawings. A resultant beam of light carrying information representative of the images on the scanned document sheet is directed to an image reproduction system 12 as indicated by arrow L.

The images carried by the light beam thus directed to the image reproduction system 12 are provisionally recorded in the form of latent images, which are then developed into visible toner images through an electrophotographic process performed by the image reproduction system 12. The visible toner images are transferred to any record medium such as typically a print sheet transported by a print sheet feed assembly 14 and the print sheet now carrying the reproduced images is withdrawn out of the apparatus by means of an image-fixing and sheet discharge system 16.

The image reproducing system 12 of the image forming apparatus embodying the present invention comprises a photosensitive image transfer drum 18 having a photoconductive peripheral surface. The light directed from the optical scanning system is incident on the peripheral surface of this image transfer drum 18. The drum 18 is rotatable about its center axis and is driven for rotation at a fixed peripheral speed by means of a main drive motor $M_D$ of the apparatus.

The image reproducing system 12 of the apparatus embodying the present invention further comprises a main charger 20 to sensitize the photoconductive peripheral surface of the image transfer drum 18. Posterior to the path of light to the drum 18 is located an image developing stage 22 which is herein shown as including one or more developing units detachably mounted in the apparatus and each having a stock of a developer powder composed of a mixture of electrostatically charged carrier particles and black or otherwise colored toner particles.

Further posterior to the developing stage 22 in turn is provided an image transfer charger 24 which is operative to charge the print sheet so that the toner images formed on the drum 18 are transferred to the print sheet. The print sheet thus having the toner images carried thereon is cleared of charges by a separation charger 26 which is located posterior to the transfer charger 24. There is further provided a drum cleaner unit 28 which removes any residual toner particles from the peripheral surface of the drum 18. Posterior to this cleaner unit 28 in turn is located a charge eraser lamp 30 which irradiates the cleaned peripheral surface of the drum 18 to eliminate the charges which may be left thereon.

The copy-sheet feed assembly 14 of the image forming apparatus is provided in conjunction with at least one print sheet supply cassette 32 detachably fitted to the housing 10 and having encased therein a stock of print sheets. The print sheet feed assembly 14 per se comprises a print sheet feed roller 34 provided in association with the cassette 32. This print sheet feed roller 34 is driven for rotation for picking up print sheets one after another from the stack of print sheets in the cassette 32. A print sheet thus picked up from the print sheet supply cassette 32 is passed through a pair of guide rollers 36 toward the image transfer drum 18.

Between the developing stage 22 and the transfer charger 24 in the direction of rotation of the drum 18 is provided a pair of timing rollers 38. A print sheet which has been transported toward the image transfer drum 18 through the guide rollers 36 is brought into contact with the peripheral surface of the drum 18 past these timing rollers 38. The timing rollers 38 are driven for rotation at a timing synchronized with the operation of the optical scanning system. The timing rollers 38 are further operative to rectify the direction of the print sheet to be fed to the peripheral surface of the drum 18. The print sheet feed roller 34, guide roller pair 36 and timing roller pair 38 are also driven from the main drive motor $M_D$ of the apparatus by means of solenoid-operated clutches (not shown) respectively associated with the roller 34 and roller pairs 36 and 38.

The image-fixing and sheet discharge system 16 of the apparatus embodying the present invention comprises a print sheet transport belt assembly 40 positioned posterior to the area where the print sheet is to be separated from the image transfer drum 18. The print sheet separated from the drum 18 is thus conveyed on the belt assembly 40 to an image fixing assembly 42 provided at the rear of the belt assembly 40. The toner particles carried on the print sheet are thus thermally fused and the toner images fixed on the print sheet by means of this image fixing assembly 42. The print sheet released from the image fixing assembly 42 is withdrawn from the apparatus by means of a pair of discharge rollers 44 and a print sheet discharge tray 46 attached to the housing 10 through a slot provided in the housing 10. A continuous path for print sheets is thus established which extends from the print sheet feed assembly 14 to the image-fixing and sheet discharge system 16 or, more specifically from the print sheet feed roller 34 to the print sheet discharge roller pair 44.

The image forming apparatus embodying the present invention further comprises various sensors and detectors which in the shown embodiment of the present invention include first and second print sheet jam sensors 48 and 50 adapted to detect a print sheet to be transported from the print sheet feed assembly 14 to the image reproduction system 12 and a print sheet to be withdrawn from the apparatus through the image-fixing and sheet discharge system 16. The first print sheet jam sensor 48 is located typically in conjunction with the timing roller pair 38 and is operative to produce a signal $S_{PS1}$ of, for example, a logic "1" state in response to a print sheet being passed from the print sheet guide roller pair 36 to the timing roller pair 38. The second print sheet jam sensor 50 is located typically in conjunction with the discharge roller pair 44 and is operative to produce a signal $S_{PS2}$ of, for example, a logic "1" state in response to a print sheet being passed from the image fixing assembly 42 to the print sheet discharge roller pair 44.

The image forming apparatus embodying the present invention further comprises print sheet jam detect means adapted to detect a print sheet jammed in the path of print sheet from the print sheet feed assembly 14 toward the image-fixing and sheet discharge system 16. In the description to follow, the jamming of a print sheet as caused in the path of print sheet from the print sheet feed assembly 14 or more specifically from the print sheet feed roller 34 toward the timing roller pair 38 will be referred to jamming of the first type and the jamming of a print sheet as caused in the path of print sheet from the timing roller pair 38 toward the image-fixing and sheet discharge system 16 or more specifically toward the print sheet discharge roller pair 44 will be referred to jamming of the second type. Thus, the first print sheet jam sensor 48 located in conjunction with the timing roller pair 38 is adapted to produce the signal $S_{PS1}$ of logic "1" state in response to a print sheet causing jamming of the first type, and the second print sheet jam sensor 50 located in conjunction with the discharge roller pair 44 is adapted to produce the signal $S_{PS2}$ of logic "1" state in response to a print sheet causing jamming of the second type.

From the signal $S_{PS1}$ of the logic "1" or "0" state produced by the first print sheet jam sensor 48, it is determined that jamming of the first type is caused if and when (1/1) a print sheet has failed to reach the timing roller pair 38 within a first predetermined period of time after the print sheet feed roller 34 is initiated into operation or the signal $S_{PS1}$ from the jam sensor 48 remains in the logic "0" state for the first predetermined period of time after the print sheet feed roller 34 is actuated to operate, (1/2) a print sheet has failed to be passed through the timing roller pair 38 within a second predetermined period of time after the timing roller pair 38 is initiated into operation, or the signal $S_{PS1}$ from the jam sensor 48 remains in the logic "1" state for the second predetermined period of time after the timing roller pair 38 is actuated to operate, and (1/3) there is a print sheet present immediately anterior to the timing roller pair 38, or the signal $S_{PS1}$ from the jam sensor 48 remains in the logic "1" state until the print sheet feed roller 34 is initially actuated to operate for rotation.

From the signal $S_{PS2}$ of logic "1" or "0" state which is produced by the second print sheet jam sensor 50, it is determined that jamming of the second type is caused if and when (2/1) a print sheet has failed to reach the discharge roller pair 44 within a third predetermined period of time after the timing roller pair 38 is initiated into operation, or the signal $S_{PS2}$ from the jam sensor 50 remains in the logic "0" state for the third predetermined period of time after the timing roller pair 38 is actuated to operate, (2/2) a print sheet has failed to be passed through the discharge roller pair 44 within a fourth predetermined period of time after the discharge roller pair 44 is initiated into operation, or the signal $S_{PS2}$ from the jam sensor 50 remains in the logic "1" state for the fourth predetermined period of time after the discharge roller pair 44 is actuated to operate, and (2/3) there is a print sheet present immediately anterior to the discharge roller pair 44, or the signal $S_{PS2}$ from the jam sensor 50 remains in the logic "1" state until the print sheet feed roller 34 is initially actuated to operate.

In association with the print sheet jam detect means including the first and second print sheet jam sensors 48 and 50 thus arranged is provided a jam reset switch 52 which may be arranged to produce a signal $S_{JR}$ responsive to elimination of a jammed condition caused as described in any of the paragraphs 1/1 to 1/3 or paragraphs 2/1 to 2/3 above or when the switch 52 is manually operated after the jammed condition is remedied.

Figure 2:
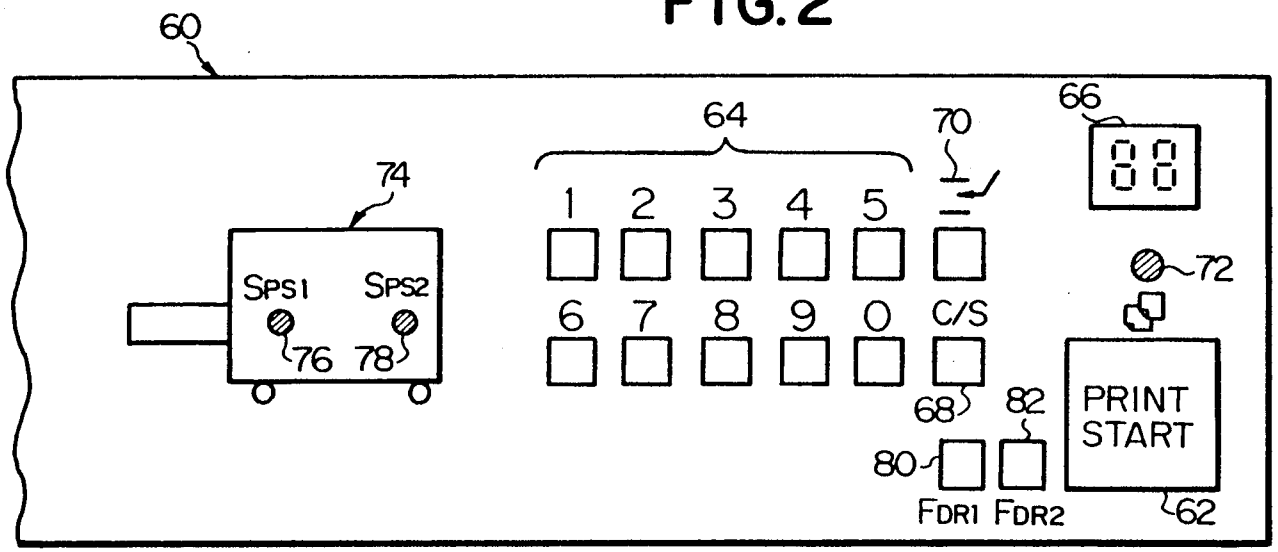
FIG. 2 is a fragmentary plan view schematically showing the configuration of a portion of a control panel forming part of the image duplicating apparatus embodying the present invention.

FIG. 2 shows the switch, display and indicator configuration of a portion of a control panel 60 which forms part of the image forming apparatus embodying the present invention. The control panel 60 comprises a print start switch 62 to start copying operation and a set of numerical switches 64 allocated to numerals 1, 2, . . . and 0, respectively. A selected quantity of printed outputs to be produced is entered from these numerical switches 64. The quantity of prints thus entered is displayed in a seven-segment display section 66 and can be cleared from a clear/stop switch 68 (C/S) which may be used also for cancelling any instruction once entered from the print start switch 62. During printing of a preset quantity of print sheets for a given document sheet, another document sheet may be duplicated in an interrupt mode entered at an interrupt request switch 70.

In association with the print start switch 62 is further provided a print ready/unready indicator 72 which is to be turned off to indicate that the apparatus is in a condition ready to operate and is activated to illuminate in red to indicate that the apparatus is not ready for operation. The image forming apparatus embodying the present invention is "in a condition ready to operate" if there is no failure or accident such as jamming currently caused in the apparatus or if any failure or accident caused in the past has been eliminated or remedied with, for example, the jammed print sheet removed out of the apparatus. When the apparatus embodying the present invention is in "a condition ready to operate", the image fixing assembly 44 of the image-fixing and sheet discharge system 16 is properly warmed up and the control circuit of the apparatus is ready to accept an instruction signal from the print start switch 62.

The control panel 60 of the apparatus embodying the present invention further comprises a jam monitor section 74 in which are located first and second jam indicators 76 and 78. The first jam indicator 76 is activated to turn on in response to an occurrence of the jamming of the first type caused as described in any of the paragraphs 1/1 to 1/3, and the second jam indicator 76 is activated to turn on in response to an occurrence of the jamming of the second type caused as described in any of the paragraphs 2/1 to 2/3. The number of occurrences of the jamming of each of the first and second types is counted automatically and may be be displayed on the display section 66 when a first jam count display request switch 80 is depressed for the jamming of the first type or a second jam count display request switch 82 is depressed for the jamming of the second type, respectively. The number of occurrences of the jamming thus displayed on the display section 66 can be cleared when the clear/stop switch 68 is depressed after the first or second jam count display request switch 80 or 82 has been depressed.

Figure 3:
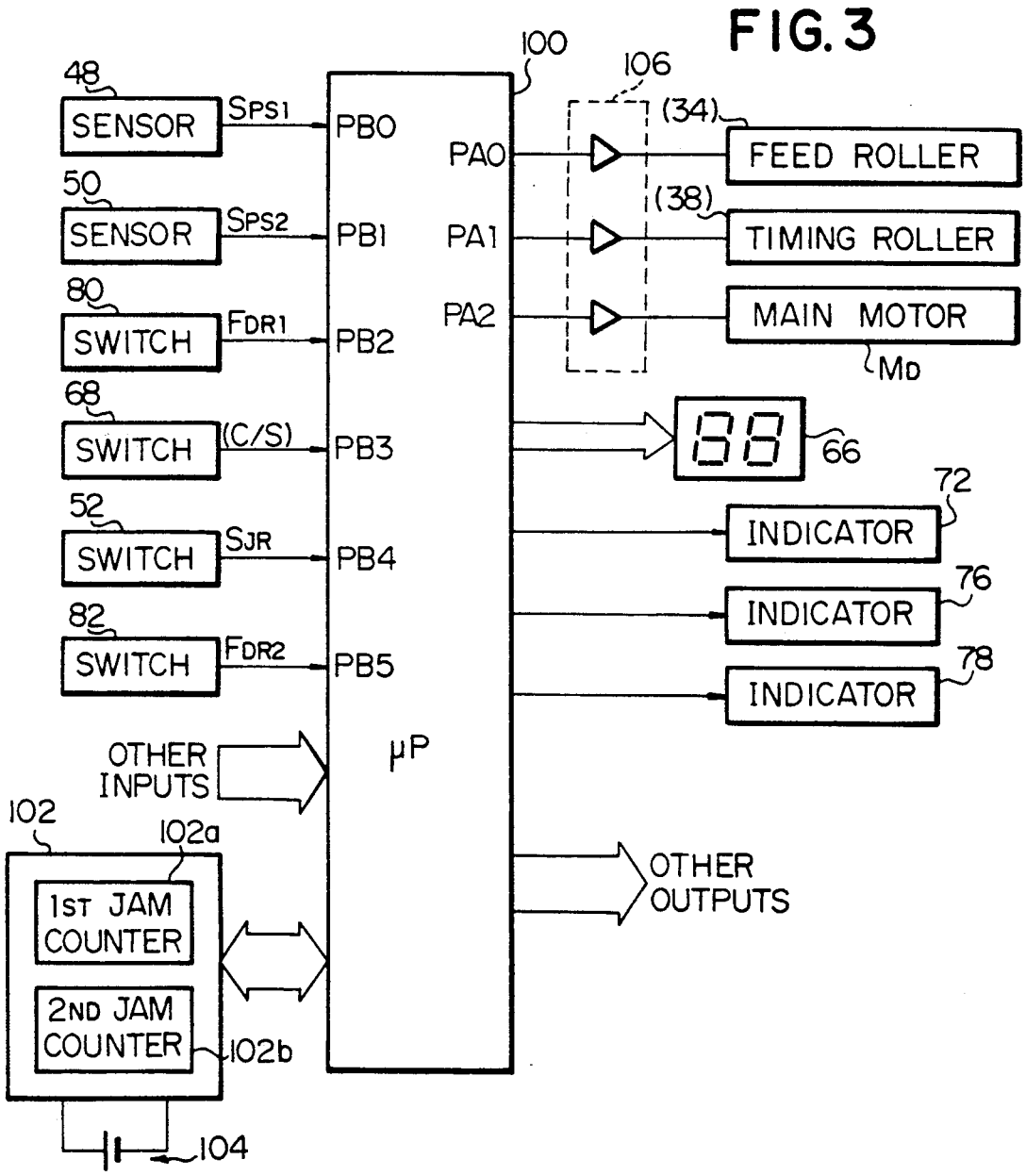
FIG. 3 is a block diagram schematically showing the general arrangement of a control circuit which may be incorporated in the image duplicating apparatus embodying the present invention.

FIG. 3 shows the general arrangement of a control circuit which may be used to achieve various modes and conditions of copying operation in the apparatus embodying the present invention. The control circuit comprises a single-chip microprocessor unit 100 having input terminals connected to the various sensors and detectors included in the apparatus shown in FIG. 1 and the various switches included in the control panel 100 described with reference to FIG. 2. These input terminals include input terminals PB0 and PB1 connected to the first and second print sheet jam sensors 48 and 50, respectively, an input terminal PB2 connected to the first jam count display request switch 80, an input terminal PB3 connected to the clear/stop switch 68, an input terminal PB4 connected to the jam reset switch 52, and input terminal PB5 connected to the jam count display request switch 82.

In response to the signals $S_{SP1}$ and $S_{SP2}$ from the first and second print sheet jam sensors 48 and 50, the microprocessor unit 100 detects an occurrence of the jamming of the first type as hereinbefore described in any of the paragraphs 1/1 to 1/3 or an occurrence of the jamming of the second type as hereinbefore described in the paragraphs 2/1 to 2/3. When the first jam count display request switch 80 is depressed and turned on, the microprocessor unit 100 produces a first display request flag $F_{DR1}$ of a logic "1" state requesting that the number of occurrences of the jamming of the first type be displayed in the display section 66. Likewise, when the second jam count display request switch 82 is depressed and turned on, the microprocessor unit 100 produces a second display request flag $F_{DR2}$ of a logic "1" state requesting that the number of occurrences of the jamming of the second type be displayed in the display section 66. The first or second display request flags $F_{DR2}$ of the logic "1" thus produced is reset to a logic "0" state when the clear/stop switch 68 is depressed after the jam count display request switch 80 or 82 is depressed.

The microprocessor unit 100 is connected to a random-access memory (RAM) 102 having memory areas 102*a* and 102*b* for storing the numbers of occurrence of the jamming as detected by the first and second print sheet jam sensors 48 and 50, respectively. In response to the signals $S_{SP1}$ and $S_{SP2}$ from the first and second print sheet jam sensors 48 and 50, the microprocessor unit 100 detects an occurrence of the jamming of a print sheet and in a manner hereinbefore described in any of the paragraphs 1/1 to 1/3 or paragraphs 2/1 to 2/3 and increments the content of the memory area 102*a* or the memory area 102*b* each time an occurrence of the jamming of the first or second type, respectively, is detected. The memory 102 has a backup power source 104 to periodically refresh the contents of the memory 102.

The microprocessor unit 100 of the control circuit shown in FIG. 3 further has output terminals connected to various drivers for the various actuators provided in the apparatus shown in FIG. 1 and the control panel 60 described with reference to FIG. 2. These output terminals include an output terminal PA0 connected to a driver for the clutch associated with the print sheet feed roller 3, an output terminal PA1 connected to a driver for the clutch associated with the timing roller pair 38, and an output terminal PA2 connected to a driver for the main drive motor $M_D$ of the apparatus shown in FIG. 1. Indicated commonly at 106 are the drivers connected to these roller actuator clutches and main drive motor. The output terminals of the microprocessor unit 100 further include those connected to drivers for the display section 66, a driver for the print ready-/unready indicator 72, and drivers for the first and second jam indicators 76 and 78.

Figure 4:
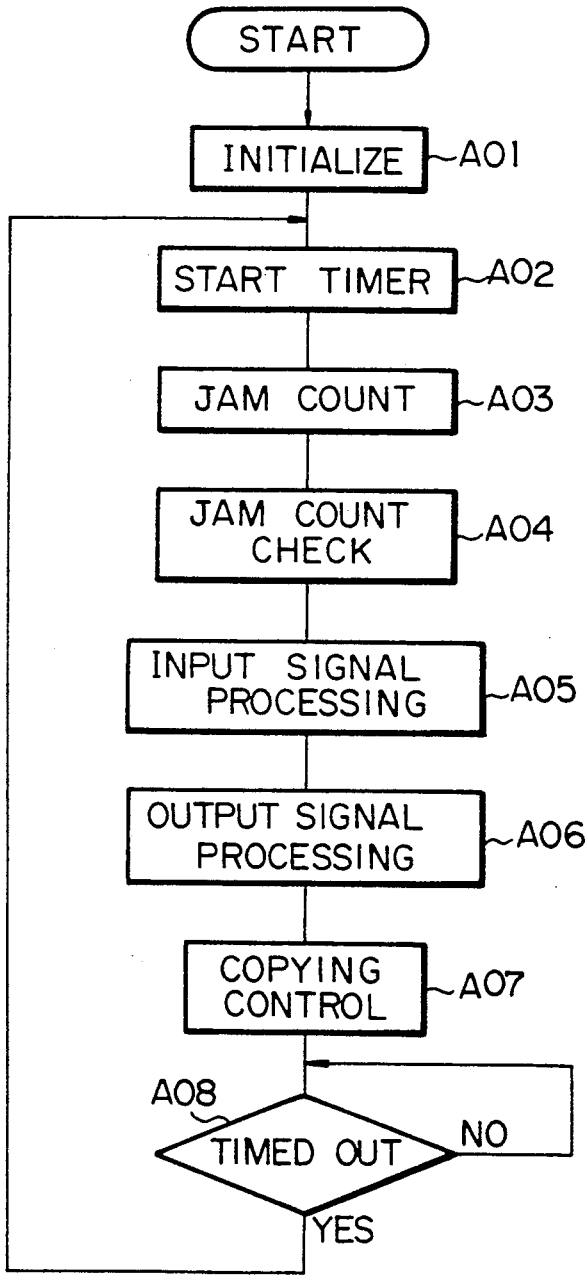
FIG. 4 a flowchart showing a preferred example of the main routine program to be executed by a master cpu included in the control circuit illustrated in FIG. 3.

FIG. 4 a flowchart showing a preferred example of the main routine program to be executed by the microprocessor unit 100 thus included in the control circuit hereinbefore described with reference to FIG. 3.

The main routine program shown in FIG. 4 is started with the image forming apparatus switched in and first proceeds to step A01 at which all the parameters and flags relating to various copying conditions and modes of operation to be performed under the control of the microprocessor unit 100 are initialized in accordance with prescribed default rules. An internal timer of the microprocessor unit 100 is then initiated at a step A02 to count the time interval predetermined for a single complete iteration of the routine program.

The microprocessor unit 100 may now execute a jam count subroutine program A03 to count the number of occurrences of the jamming of the first and second types which may have been caused in the apparatus after the apparatus has initially been switched in. Details of some preferred examples of this jam count subroutine program A03 will be hereinafter described with reference to FIGS. 5, 7, 8 and 9. The microprocessor unit 100 may then execute a jam count check subroutine program A04 to check the count of the jamming of the first type or the second type and display the count in the count if requested through the jam count display request switch 80 or 82. The details of this jam count check subroutine program A04 will be hereinafter described with reference to FIGS. 6A and 6B.

The microprocessor unit 100 may further execute an input signal process subroutine program A05 to process various instruction and data signals supplied from the control panel 60 and a subroutine program A06 to generate signals to be supplied to the various display and indicator elements provided on the control panel 60. Thereafter, the microprocessor unit 100 may execute a copying control subroutine program A07 predominant over the various aspects and phases of copying operation to be performed by image forming apparatus embodying the present invention in accordance with the instruction and data signals supplied from the control panel 60 shown in FIG. 2. Upon lapse of the predetermined time interval as detected at a step A08 after the internal timer of the microprocessor unit 100 has been initiated at the step A02, the microprocessor unit 100 reverts to the step A02 and recycles the subroutine programs A03 to A07.

Jam Count Subroutine Program (A03/1)

Figure 5:
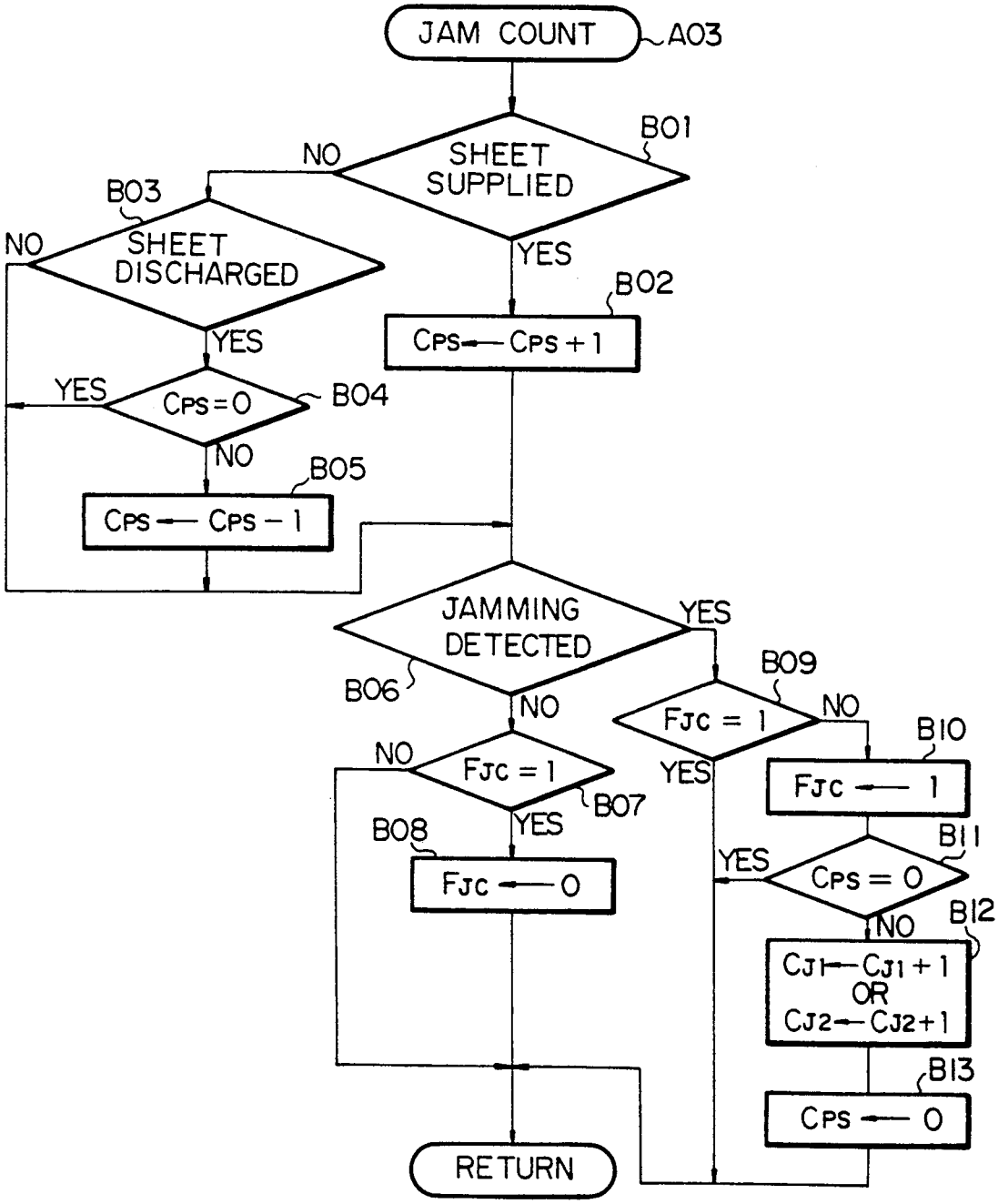
FIG. 5 is a flowchart showing the details of a first preferred example of a jam count subroutine program included in the main routine program illustrated in FIG. 4.

FIG. 5 shows the details of a first preferred example (A03/1) of the jam count subroutine program A03 included in the main routine program hereinbefore described with reference to FIG. 4.

The jam count subroutine program A03/1 starts with a decision step B01 to check if there is a print sheet supplied from the print sheet supply cassette 32. This decision may be made on the basis of the signal $S_{SP1}$ of logic "1" state produced by the first print sheet jam sensor 48 after the clutch for the print sheet feed roller 34 is actuated. If the answer for this decision step B01 is given in the affirmative, the subroutine program A03/1 proceeds to step B02 to increment the content $C_{PS}$ of a print sheet supply counter stored in the memory 102 (FIG. 3). If it is found at step B01 that there currently is no print sheet supplied from the print sheet supply cassette 32, the step B01 is followed by a decision step B03 at which is checked if there is a print sheet discharged through the print sheet discharge roller pair 44. This decision may be made on the basis of the signal $S_{PS2}$ of logic "0" state produced by the second print sheet jam sensor 50 after the clutch for the print sheet discharge roller pair 44 is actuated. If the answer for this decision step B03 is given in the affirmative, it is further tested at step B04 whether or not the content $C_{PS}$ of the print sheet supply counter is of the "038 state. If the answer for this decision step B04 is given in the negative, the step B04 is followed by a step B05 to decrement the content $C_{PS}$ of the print sheet supply counter.

Thus, the print sheet supply counter increments its content $C_{PS}$ each time a print sheet is found to be supplied from the print sheet supply cassette 32 and decrements the content $C_{PS}$ each time a print sheet is found to be discharged through the print sheet discharge roller pair 44. As far as image forming apparatus is operating in normal conditions, the number of the print sheets supplied through the print sheet feed roller 34 must be equal to the number of the print sheets discharged through the print sheet discharge roller pair 44. The content $C_{PS}$ of the print sheet supply counter as for this reason at all times updated to the "0" state each time a print sheet is discharged from the apparatus. In the event the jamming of a print sheet is caused, the content $C_{PS}$ of the print sheet supply counter will remain in the "1" state at a timing when a print sheet would have been discharged through the print sheet discharge roller pair 44. The number of occurrences of the jamming caused in the apparatus can thus be determined through detection of the content $C_{PS}$ of the print sheet supply counter.

Subsequently to the step B02 or B05 or if the answer for the step B03 is given in the negative or the answer for the step B04 given in the affirmative, it is detected at step B06 whether or not there is the jamming of a print sheet caused in image forming apparatus. This decision is made on the basis of the signals $S_{PS1}$ and $S_{PS2}$ from the print sheet jam sensors 48 and 50 in any of the manners hereinbefore described in paragraphs 1/1 to 1/3 and 2/1 to 2/3. If it is determined at this step B06 that there is no jamming detected, the step B06 is followed by a step B07 at which is queried whether or not a jam count flag $F_{JC}$ is of a logic "1" state. This jam count flag $F_{JC}$ is set to be of the logic "1" state when there is a jammed condition detected and of a logic "0" state in the absence of the jammed condition.

If the answer for the step B07 is given in the affirmative, or, in other words, the jam count flag $F_{JC}$ is found to be of the logic "1" state, the jam count flag $F_{JC}$ is reset to a logic "0" state at step B08. If the answer for this step B07 is given in the negative or, in other words, the jam count flag $F_{JC}$ is found to be of the logic "0" state, the execution of the subroutine program A03/1 is terminated and is followed by the subsequent jam count check subroutine program A04 of the main routine program illustrated in FIG. 4.

If it is determined at step B06 that there is a jamming currently detected, the step B06 is followed by a step B09 at which is queried whether or not the jam count flag $F_{JC}$ is of a logic "1" state. If the answer for this step B09 is given in the affirmative or, in other words, the jam count flag $F_{JC}$ is found to be of the logic "1" state, the execution of the subroutine program A03/1 is terminated and is followed by the subsequent jam count check subroutine program A04 of the main routine program.

If the answer for the step B09 is given in the negative with the jam count flag $F_{JC}$ found to be of the logic "1" state, the step B09 is followed by a step B10 at which the jam count flag $F_{JC}$ is set to the logic "1" state. Subsequently to step B10, it is checked at step B11 whether or not the content $C_{PS}$ of the print sheet supply counter is of the "0" state. If the answer for this decision step B11 is given in the affirmative, the execution of the subroutine program A03/1 is terminated and is followed by the subsequent jam count check subroutine program A04 of the main routine program. If it is found at step B11 that the content $C_{PS}$ of the print sheet supply counter is of the "1" state, then the step B11 is followed by a step B12 to increment the content $C_{J1}$ of a first jam counter or the content $C_{J2}$ of a second jam counter as the case may be. The first jam counter is assigned to the jamming of the first type and the content $C_{J1}$ thereof is indicative of the number of occurrences of the jamming of the first type. The second jam counter is assigned to the jamming of the second type and the content $C_{J2}$ thereof is indicative of the number of occurrences of the jamming of the second type. The contents $C_{J1}$ and $C_{J2}$ of the first and second jam counters are stored in the memory 102 (FIG. 3). The step B12 is followed by a step B13 at which the content $C_{PS}$ of the print sheet supply counter is reset to the "0" state, whereupon the execution of the subroutine program A03/1 is terminated and is followed by the subsequent jam count check subroutine program A04 of the main routine program.

In the event an occurrence of jamming is detected and thereafter image forming apparatus is initiated into operation without remedying the jammed condition, the occurrence of the jamming will be detected for a second time from the signal $S_{PS1}$ or $S_{PS2}$ from the print sheet jam sensor 48 or 50 at step B06. The jamming under consideration having been caused before the print sheet feed roller 34 is actuated for a second time, the content $C_{PS}$ of the print sheet supply counter determined to be of the "0" state at step B11 is maintained with the answer for each of the steps B01 and B03 given in the negative during second iteration of the subroutine program A03/1. The subroutine program A03/1 is, for this reason, terminated without incrementing the contents $C_{J1}$ and $C_{J2}$ of the first and second jam counters as at step B13.

As will have been understood from the foregoing description, the number of occurrences of the jamming is counted in the subroutine program A03/1 on condition that the content $C_{PS}$ of the print sheet supply counter, which increments its content each time a print sheet is supplied from the supply cassette 32 and decrements the content each time a print sheet is discharged through the print sheet discharge roller pair 44, is not of the "0" state. In addition, the content $C_{PS}$ of the print sheet supply counter is reset to the "0" state at step B13 after the content $C_{J1}$ of the first jam counter or the content $C_{J2}$ of the second jam counter is incremented at step B12. If the jammed condition detected during a cycle of copying operation is for a second time detected during the immediately subsequent copying operation, the contents $C_{J1}$ and $C_{J2}$ of the first and second jam counters are not incremented at step B13 unless and until the content $C_{PS}$ of the print sheet supply counter is incremented at step B02 with a print sheet supplied from the supply cassette 32 after the jammed condition detected during, the preceding copying operation is remedied. In this manner, an occurrence of the jamming detected during a cycle of copying operation is counted at step B12 if it is confirmed at step B01 that a print sheet has been supplied from the supply cassette 32 and at step B06 that the jamming caused and detected during the immediately preceding cycle of operation has been remedied properly by the operator of image forming apparatus. If it is not confirmed at step B01 that a print sheet has been supplied from the supply cassette 32 during a cycle of copying operation subsequent to the cycle of operation in which an occurrence of jamming was detected, the content $C_{PS}$ of the print sheet supply counter is not incremented at step B02 during the current cycle of operation so that the jamming detected at step B06 during the immediately preceding cycle of operation has not been remedied. In this instance, the occurrence of the jamming detected during the current cycle of copying operation is deemed to be just the one that was caused and detected during the immediately preceding cycle of operation and is not counted at step B12 during the current cycle of operation.

Jam Count Check Subroutine Program (A04)

Figure 6A:
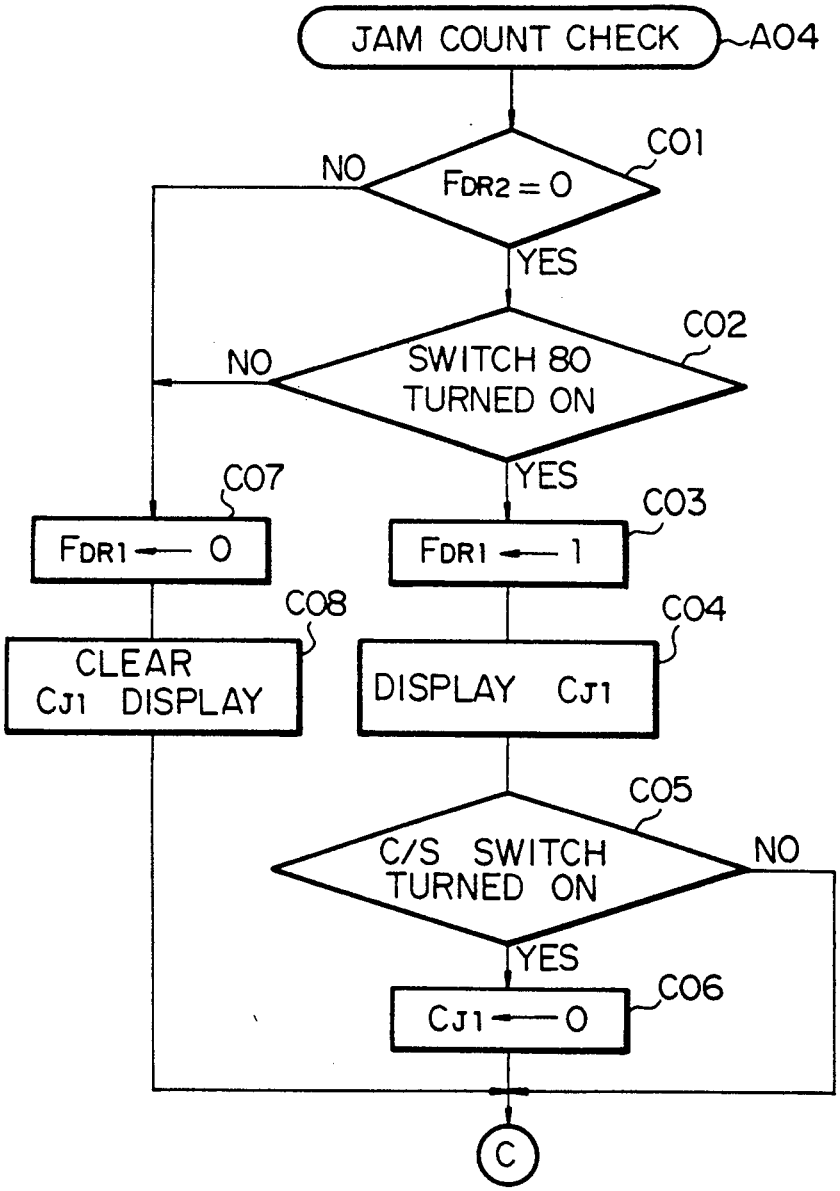
FIGS. 6A and 6B are flowcharts showing the details of a jam count check subroutine program also included in the main routine program illustrated in FIG. 4.
Figure 6B:
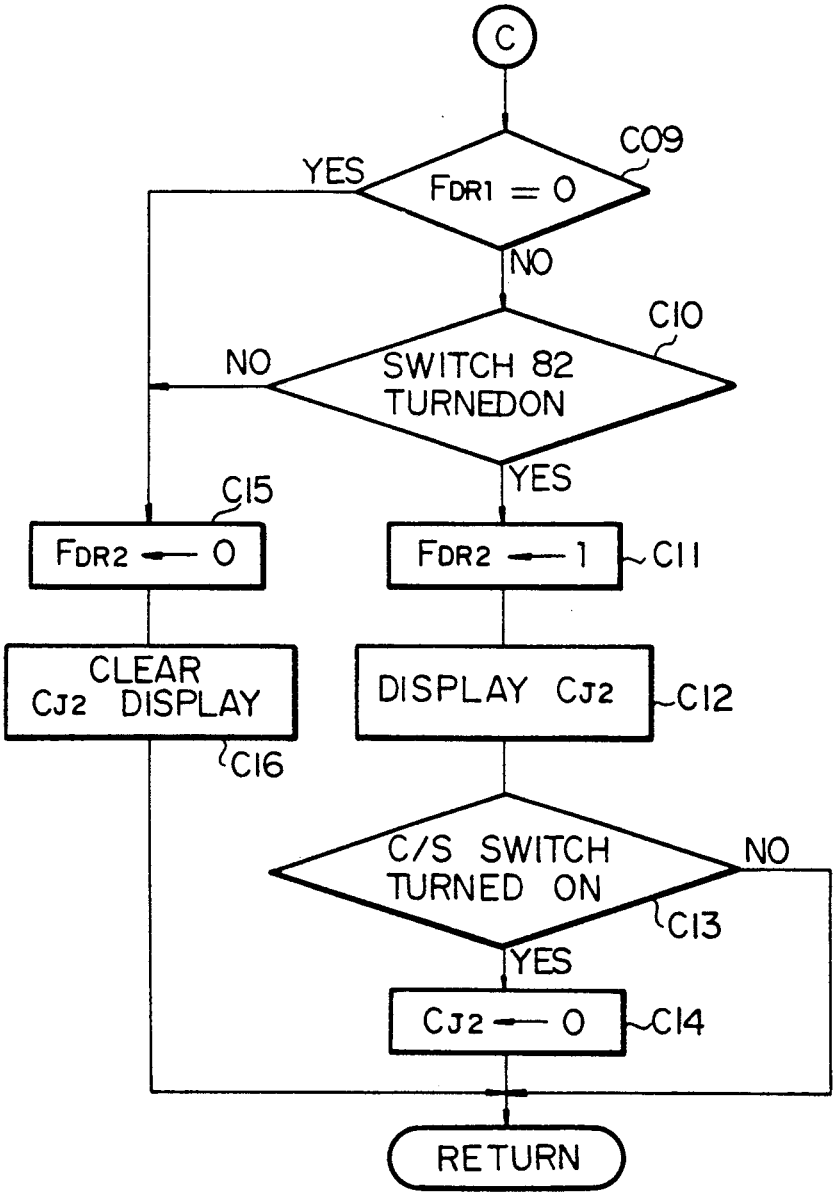

FIGS. 6A and 6B are flowcharts showing the details of the jam count check subroutine program A04 which is also included in the main routine program described with reference to FIG. 4.

The jam count check subroutine program A04 starts with a decision step C01 to check if the second display request flag $F_{DR2}$ is of a logic "0" state. As noted previously, the second display request flag $F_{DR2}$ is of a logic "1" state when the second jam count display request switch 82 is depressed to request that the number of occurrences of the jamming of the second type be displayed in the display section 66. If it is found at step C01 that there is present the second display request flag $F_{DR2}$ of the logic "0" state, it is further tested at step C02 whether or not the first jam count display request switch 80 is depressed and turned on. If the answer for the step C02 is given in the affirmative with the first jam count display request switch 80 found to be turned on, the first display request flag $F_{DR1}$ is set to logic "1" state at step C03, which is followed by a step C04 at which the microprocessor unit 100 fetches the content $C_{J1}$ of the first jam counter from the memory 102 (FIG. 3) and displays the numeral corresponding to the content $C_{J1}$ of the first jam counter in the display section 66 of the control panel 60. The first display request flag $F_{DR1}$ is of a logic "1" state when the first jam count display request switch 80 is depressed to request that the number of occurrences of the jamming of the first type be displayed in the display section 66, as noted previously.

Subsequently to step C04, it is queried at step C05 whether or not the clear/stop switch 68 is depressed. As noted previously, the numeral indicating the number of occurrences of the jamming displayed in the display section 66 is cleared when the clear/stop switch 68 is depressed with the first jam count display request switch 80 turned on. The fact that the clear/stop switch 68 is depressed with the first jam count display request switch 80 turned on indicates that the jamming of the first type has been remedied by the operator or serviceman. If the answer for the step C05 is given in the affirmative, the content $C_{J1}$ of the first jam counter is thus reset to the "0" state at step C06.

By virtue of the steps C01 to C06, the serviceman is enabled to locate the cause of occurrence of the jamming of the first type from the count displayed in the display section 66 of the control panel 60 at step C04 and may then exchange any strategic part or assembly of image forming apparatus such as the print sheet feed roller 34 with a new one. After the serviceman has exchanged the part or assembly with the new one or has located the trouble from the count of the jamming displayed, he may depress the clear/reset switch 68 so that the content $C_{J1}$ of the first jam counter is reset to the "0" state as at step C06. This step C06 is thus useful for facilitating the serviceman's servicing jobs to be done when he attends the apparatus for a second time.

If it is found at step C01 that the second display request flag $F_{DR2}$ is not of the logic "0" state or it is found at step C02 that the first jam count display request switch 80 is not depressed and turned on, the first display request flag $F_{DR1}$ is reset to logic "0" state at step C07, which is followed by a step C08 at which the number of occurrences of the jamming displayed in the display section 66 is cleared. Subsequently to step C06 or step C08 or if it is found at step C05 that the clear/stop switch 68 is not depressed and turned on, the subroutine program A04 proceeds to a decision step C09 to check if the first display request flag $F_{DR1}$ is of a logic "0" state. If it is found at step C09 that there is the first display request flag $F_{DR1}$ is not of the logic "0" state, it is further tested at step C10 whether or not the second jam count display request switch 82 is depressed and turned on. If the answer for the step C10 is given in the affirmative with the second jam count display request switch 82 found to be turned on, the second display request flag $F_{DR2}$ is set to logic "1" state at step C11, which is followed by a step C12 at which the microprocessor unit 100 fetches the content $C_{J2}$ of the second jam counter from the memory 102 and displays the numeral corresponding to the content $C_{J2}$ of the second jam counter in the display section 66 of the control panel 60.

Subsequently to step C12, it is queried at step C13 whether or not the clear/stop switch 68 is depressed. The act that the clear/stop switch 68 is depressed with the second jam count display request switch 82 turned on indicates that the jamming of the second type has been remedied so that, if the answer for the step C13 is given in the affirmative, the content $C_{J2}$ of the second jam counter is reset to the "0" state at stem C14.

By virtue of the steps C09 to C14, the serviceman is enabled to locate the cause of occurrence of the jamming of the second type from the count displayed in the display section 66 of the control panel 60 as at step C12 and may then exchange any strategic part or assembly of image forming apparatus such as the print sheet discharge roller pair 44 with a new one. After the serviceman has exchanged the part or assembly with the new one or has located the trouble from the count of the jamming displayed, he may also depress the clear/reset switch 68 so that the content $C_{J2}$ of the second jam counter is reset to the "0" state as at step C14. The step C14 is thus useful for facilitating the serviceman's servicing jobs to be done when he attends the apparatus for a second time.

If it is found at step C09 that the first display request flag $F_{DR1}$ is of the logic "0" state or it is found at step C10 that the second jam count display request switch 82 is not depressed and turned on, the second display request flag $F_{DR2}$ is reset to logic "0" state at step C15, which is followed by a step C16 at which the number of occurrences of the jamming displayed in the display section 66 is cleared. Subsequently to step C14 or step C16 or if it is found at step C13 that the clear/stop switch 68 is not depressed and turned on, the subroutine program A04 is terminated and proceeds to the subsequent input and output signal process subroutine programs A05 and A06 in the main routine program described with reference to FIG. 4.

As will have been appreciated from the foregoing description, the jam count check subroutine program A04 as hereinbefore described is advantageous in that the content $C_{J1}$ of the first jam counter or the content $C_{J2}$ of the second jam counter can be reset to a prescribed initial state through manipulation of the clear/stop switch 68 upon completion of, for example, the servicemen's jobs exchanging any strategic part or assembly which has been determined to be responsible for the occurrence of the jamming. The jam count check subroutine program A04 will thus significantly reduce the maintenance and servicing efforts to be made by the serviceman who is enabled to readily locate the trouble, viz., the cause of the jamming of the first or second type from the count of jamming indicated in the display section 66. The numerical value thus indicated in the display section 66 of the control panel 60 corresponds to the jam count. The content $C_{J1}$ of the first jam counter or the content $C_{J2}$ of the second jam counter can be reset to the prescribed initial state through manipulation of the clear/stop switch 68 after the serviceman has serviced the image forming apparatus. When the serviceman attends the apparatus for a second time, he will be thus enabled to know the cause of the jamming readily from the count of the jamming newly indicated in the display section 66 on the basis of the updated content $C_{J1}$ or $C_{J2}$ of the first or second jam counter.

Jam Count Subroutine Program (A03/2)

Figure 7:
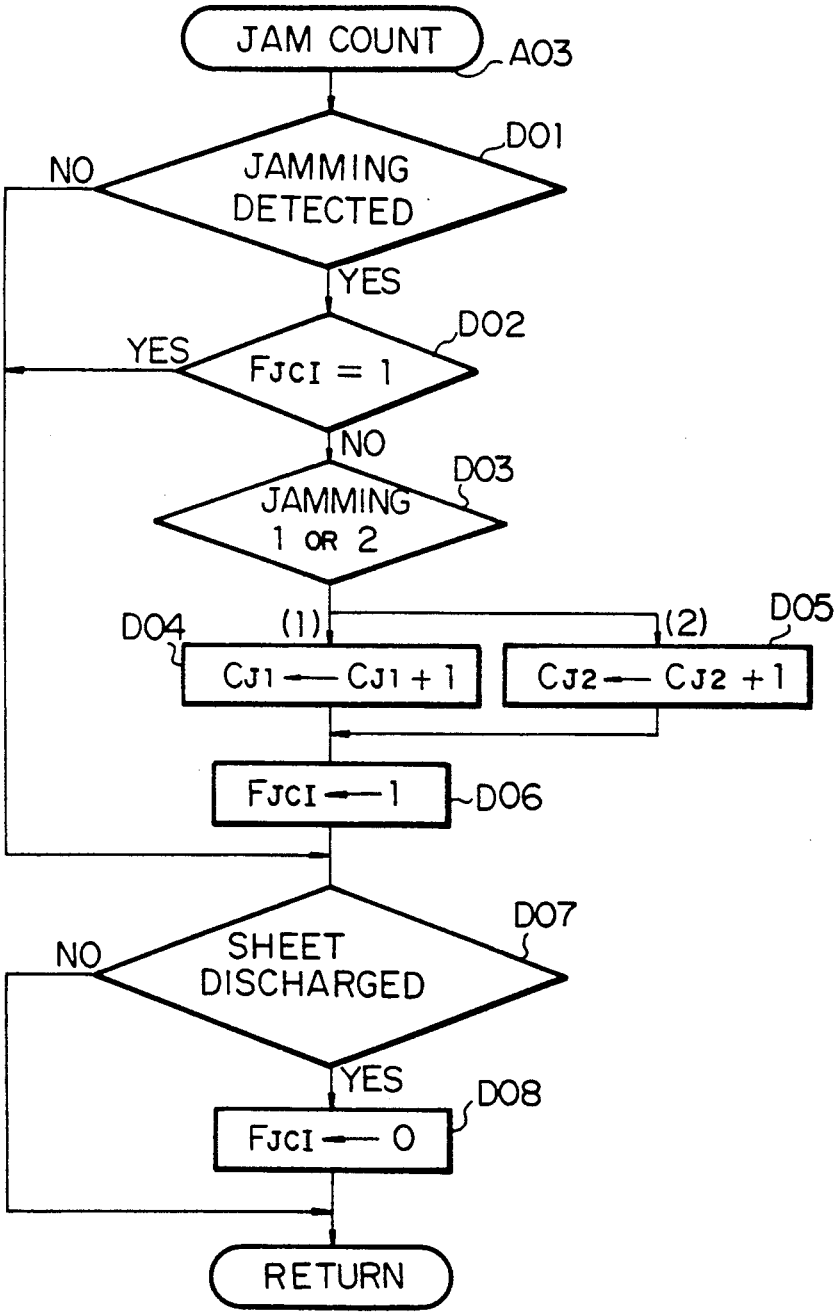
FIG. 7 is a flowchart showing the details of a second preferred example of the jam count subroutine program which is included in the main routine program illustrated in FIG. 4.

FIG. 7 shows the details of a second preferred example (A03/2) of the jam count subroutine program A03 included in the main routine program hereinbefore described with reference to FIG. 4.

The jam count subroutine program A03/2 herein shown starts with a decision step D01 to check if there is the jamming of a print sheet caused in image forming apparatus. This decision is made on the basis of the signals $S_{PS1}$ and $S_{PS2}$ from the print sheet jam sensors 48 and 50 in any of the manners hereinbefore described in paragraphs 1/1 to 1/3 and 2/1 to 2/3. If it is determined at this step D01 that there is an occurrence of jamming detected, the step D01 is followed by a step D02 at which is queried whether or not a jam count increment flag $F_{JCI}$ is of a logic "1" state. This jam count increment flag $F_{JCI}$ is set to be of the logic "1" state when the content $C_{J1}$ of the first jam counter or the content $C_{J2}$ of the second jam counter is incremented in response to a jammed condition detected and is reset to a logic "0" state when it is thereafter confirmed that a print sheet is discharged through the print sheet discharge roller pair 44.

If the answer for this step D02 is given in the negative or, in other words, the jam count increment flag $F_{JCI}$ is found to be of the logic "0" state, it is further tested at step D03 whether the jamming currently detected is of the first type or of the second type. This decision is made by determining whether it is the signal $S_{PS1}$ from the first print sheet jam sensor 48 or the signal $S_{PS2}$ from the second print sheet jam sensor from which the occurrence of the jamming is detected. If it is determined at step D03 that the jamming currently detected is of the first type, the content $C_{J1}$ of the first jam counter is incremented at step D04 and, if it is determined that the jamming is of the second type, the content $C_{J2}$ of the second jam counter is incremented at step D05. After the content $C_{J1}$ of the first jam counter is thus incremented at step D04 or the content $C_{J2}$ of the second jam counter is incremented at step D05, the jam count increment flag $F_{JCI}$ is set to logic "1" state at step D06.

Subsequently to step D06 or if the answer for the step D01 is given in the negative or the answer for the step D02 is given in the affirmative, it is confirmed at step D07 whether or not there is a print sheet discharged through the print sheet discharge roller pair 44. This decision may be made on the basis of the signal $S_{PS2}$ of logic "0" state produced by the second print sheet jam sensor 50 after the clutch for the print sheet discharge roller pair 44 is actuated. If the answer for this decision step D07 is given in the affirmative, the step D07 is followed by a step D08 at which the jam count increment flag $F_{JCI}$ is reset to logic "0" state. Subsequently to step D08 or if the answer for the step D07 is given in the negative, the execution of the subroutine program A03/2 is terminated and is followed by the subsequent jam count check subroutine program A04 of the main routine program illustrated in FIG. 4.

The second preferred example of the jam count subroutine program A03 as hereinbefore described is characterized firstly in that the number of occurrences of the jamming of the first or second type is counted (D04 or D05) on the grounds that the jam count increment flag $F_{JCI}$ which is to be reset to the logic "0" state each time a print sheet is discharged through the print sheet discharge roller pair 44 is confirmed to have been reset to the logic "0" state. The second preferred example of the jam count subroutine program A03 is characterized secondly in that the jam count increment flag $F_{JCI}$ is set to the logic "1" state (D06) each time a print sheet is discharged through the print sheet discharge roller pair 44 after the number of occurrences of the jamming of the first or second type is thus counted. Thus, if an occurrence of the jamming of the first or second type is detected at step D01, the content $C_{J1}$ of the first jam counter or the content $C_{J2}$ of the second jam counter is not updated at step D04 or D05 unless the jam count increment flag $F_{JCI}$ is set to the logic "1" state with the discharge of a print sheet during a cycle of operation started after the jammed condition has been eliminated. It will thus be understood that, through execution of the second preferred example of the jam count subroutine program A03, the content $C_{J1}$ or $C_{J2}$ of the first or second jam counter is updated when it is determined that the jamming has been duly coped with and that image forming apparatus is in a properly operable condition if it is confirmed that a print sheet has been discharged during a cycle of operation started after the jammed condition has been eliminated. If an occurrence of the jamming of the first or second type is detected while it is not confirmed that a print sheet has been discharged during a cycle of operation started after the jammed condition has been eliminated, it is determined that the jamming has not been duly coped with and that the jamming currently detected is just the one that was detected during the preceding cycle of operation and, as such, the content $C_{J1}$ or $C_{J2}$ of the first or second jam counter is not updated at step D04 or D05, respectively.

Jam Count Subroutine Program (A03/3)

Figure 8:
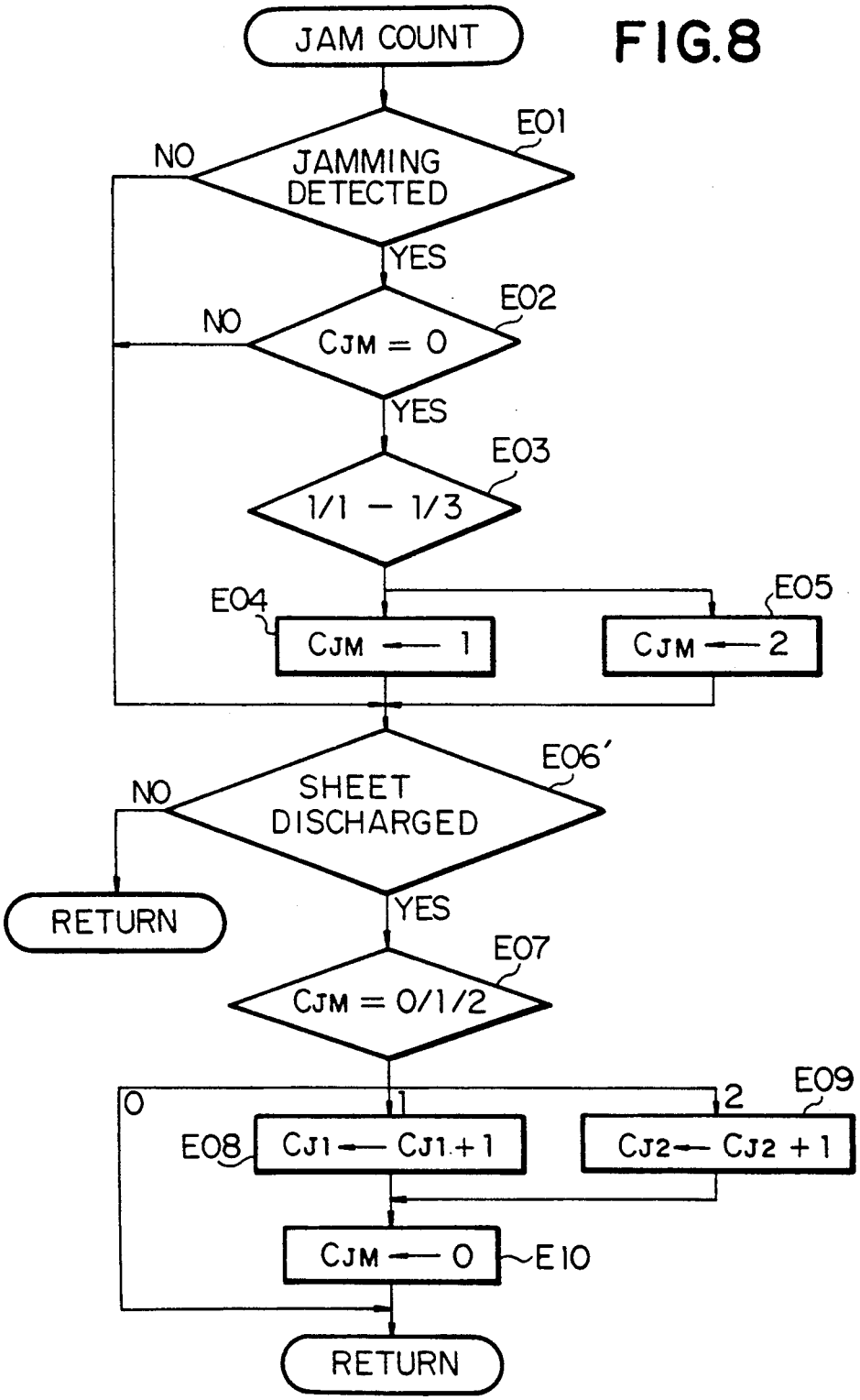
FIG. 8 is a flowchart showing the details of a third preferred example of the jam count subroutine program included in the main routine program illustrated in FIG. 4.

FIG. 8 shows the details of a third preferred example (A03/3) of the jam count subroutine program A03 included in the main routine program hereinbefore described with reference to FIG. 4.

The jam count subroutine program A03/3 herein shown starts with a decision step E01 to check, on the basis of the signals $S_{PS1}$ and $S_{PS2}$ from the print sheet jam sensors 48 and 50, if there is the jamming of a print sheet caused in image forming apparatus. If it is determined at this step E01 that there is an occurrence of jamming detected, the step E01 is followed by a step E02 at which is queried whether or not the content $C_{JM}$ of a jam memory is of a "0" state. The jam memory has stored therein a history of the jamming which has been caused in the apparatus and, thus, the content $C_{JM}$ of the jam memory may be of a "0" state which indicates that there has been no occurrence of jamming detected, a "1" state which indicates that there has been detected an occurrence of the jamming of the first type, or a "2" state which indicates that there has been detected an occurrence of the jamming of the second type.

If it is found at step E02 that the content $C_{JM}$ of the jam memory is of the "0" state indicating that there has been no occurrence of jamming detected, it is determined that the occurrence of the jamming detected at step E01 is the first occurrence of the jamming and, as such, it is further tested at step E03 whether the jamming currently detected is of the first type or of the second type. It if is determined at step E03 that the jamming currently detected is of the first type, the content $C_{JM}$ of the jam memory is updated to the "1" state at step E04 and, if it is determined that the jamming is of the second type, the content $C_{JM}$ of the jam memory is updated to the "2" state at step E05.

Subsequently to the step E04 to E05 or if the answer for the step E01 or E02 is given in the negative, it is confirmed at step E06 whether or not the print ready-/unready indicator 72 is turned off to indicate that image forming apparatus is in a condition ready to operate. As noted previously, the apparatus embodying the present invention is "in a condition ready to operate" if there is no failure or accident such as jamming currently caused in the apparatus or if any failure or accident caused in the past has been eliminated or remedied with, for example, the jammed print sheet removed out of the apparatus so that the control circuit of the apparatus is ready to accept an instruction signal from the print start switch 62. IF the answer for the step E06 is given in the negative with the print ready/unready indicator 72 turned on to illuminate in red to indicate that the apparatus is not ready for operation, the execution of the subroutine program A03/3 is terminated and is followed by the subsequent jam count check subroutine program A04 of the main routine program illustrated in FIG. 4.

If the answer for the step E06 is given in the affirmative with the print ready/unready indicator 72 turned off to indicate that image forming apparatus is in a condition ready to operate, the step E06 is followed by a step E07 at which the content $C_{JM}$ of the jam memory is checked to see if it is of the "0", "1" or "2" state. If it is determined at this step E07 that the content $C_{JM}$ of the jam memory is of the "0" state, the subroutine program A03/3 is terminated and is followed by the subsequent jam count check subroutine program A04 of the main routine program. If it is determined at the step E07 that the content $C_{JM}$ of the jam memory is of the "1" state, the content $C_{J1}$ of the first jam counter is incremented at step D08 and, if it is determined that the content $C_{JM}$ of the jam memory is of the "2" state, the content $C_{J2}$ of the second jam counter is incremented at step D09. After the content $C_{J1}$ of the first jam counter is thus incremented at step D04 or the content $C_{J2}$ of the second jam counter is incremented at step D05, the content $C_{JM}$ of the jam memory is updated to the "0" state at step E10, whereupon the execution of the subroutine program A03/3 is terminated and is followed by the subsequent jam count check subroutine program A04 of the main routine program illustrated in FIG. 4.

The third preferred example of the jam count subroutine program A03 as hereinbefore described is characterized in that the history of the jamming which has been caused in image forming apparatus is stored in the jam memory and that the number of occurrences of the jamming is incremented (E04 or E05) each time an occurrence of jamming is detected (E01) after it is confirmed (E06) that the apparatus has been conditioned to be duly operable. If it is confirmed that the jamming which as once been caused was not properly coped with and, for this reason, there is another jamming caused thereafter, it is determined that the apparatus is not in a properly operable condition and that the jamming currently detected is just the one that was detected during the preceding cycle of operation and, as such, the content $C_{J1}$ or $C_{J2}$ of the first or second jam counter is not updated at step E08 or D09, respectively.

Jam Count Subroutine Program (A03/4)

Figure 9:
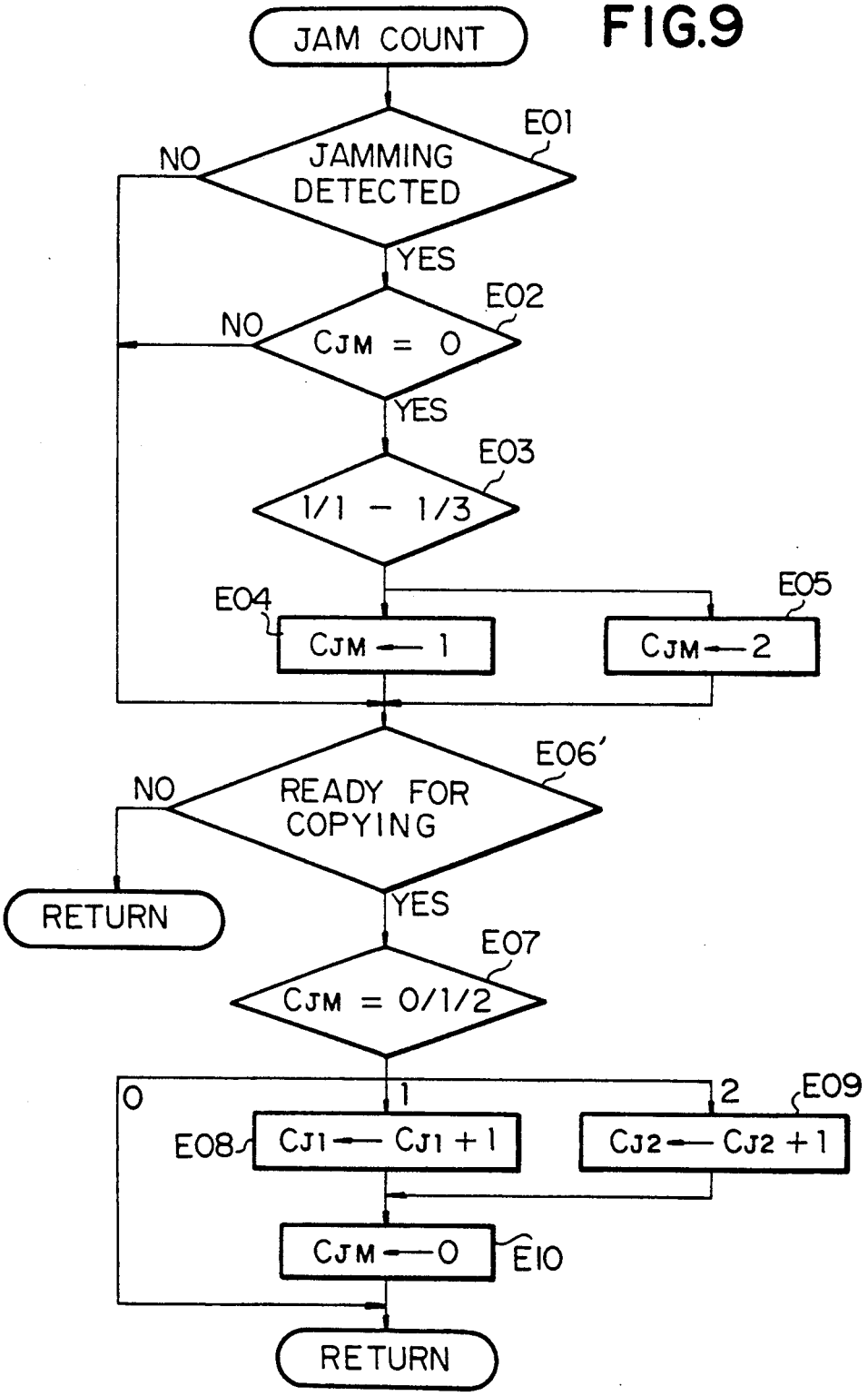
FIG. 9 is a flowchart showing the details of a fourth preferred example of the jam count subroutine program which is included in the main routine program illustrated in FIG. 4.

FIG. 9 shows the details of a fourth preferred example (A03/4) of the jam count subroutine program A03 included in the main routine program hereinbefore described with reference to FIG. 4.

The jam count subroutine program A03/4 herein shown is similar to the subroutine program A03/3 hereinbefore described with reference to FIG. 8 except for a step E06' used in the subroutine program A03/4 in substitution of the step E06 in the subroutine program A03/3 of FIG. 8.

While it is confirmed at the step E06 of the subroutine program A03/3 whether or not image forming apparatus is in a condition ready to operate, it is tested at the step E06' of the subroutine program A03/4 herein shown whether or not there is a print sheet discharged through the print sheet discharge roller pair 44. Tis decision may be made on the basis of the signal $S_{PS2}$ of logic "0" state produced by the second print sheet jam sensor 50 after the clutch for the print sheet discharge roller pair 44 is actuated. If the answer for this decision step E06' is given int eh affirmative, the step E06 is followed by the step E07 at which the content $C_{JM}$ of the jam memory is checked to see if it is of the "0", "1" or "2" state as in the subroutine program A03/3 described with reference to FIG. 8. If it is found at the step E06' that there is no print sheet discharged through the print sheet discharge roller pair 44 and accordingly the answer for the step E06 is given in the negative, the execution of the subroutine program A03/3 is terminated and is followed by the subsequent jam count check subroutine program A04 of the main routine program illustrated in FIG. 4.

The fourth preferred example of the jam count subroutine program A03 as hereinbefore described is characterized in that the history of the jamming which has been caused in the apparatus is stored in the jam memory and that the number of occurrences of the jamming is incremented (E04 or E05) each time an occurrence of jamming is detected (E01) it is confirmed (E06') that a print sheet has been duly discharged. If the jamming which as once been cause fails properly coped with and, for this reason, there is another jamming caused thereafter, it is determined that the apparatus is not in a properly operable condition and that the jamming currently detected is just the one that was detected during the preceding cycle of operation and, as such, the content $C_{J1}$ or $C_{J2}$ of the first or second jam counter is not updated at step E08 or D09, respectively.

While it has been assumed that an image forming apparatus according to the present invention is embodied in the form of a copier, it will be apparent to those skilled in the art that the gist of the present invention is also applicable to a printer.

What is claimed is:

1. An image forming apparatus comprising:

(a) image producing means for producing an image on a sheet medium, the image producing means comprising
  sheet supply means capable of successively supplying sheet media,
  an image producing stage for producing an image on each of the sheet media supplied from said sheet supply means,
  sheet discharge means for discharging from said image producing stage each of the sheet media each having an image produced thereon, (b) detecting means for detecting an occurrence of jamming of a sheet medium between said sheet supply means and said sheet discharge means, (c) a jam counter operative to count the number of occurrences of jamming of said sheet medium, said jam counter being activated to increment a counter value each time an occurrence of jamming is detected by said detecting means, and (d) control means for monitoring the operational conditions of said image producing means to confirm a ready to copy state responsive to a sheet medium supplied from said sheet supply means after an occurrence of jamming of a sheet medium has been detected by said detecting means, and prohibiting said jam counter from incrementing the counter value until the ready for copy state is confirmed, thereby preventing the jam counter from dual counting.

2. An image forming apparatus as set forth in claim 1, in which said control means is operative to disable said jam counter until a new sheet medium is supplied from said sheet supply means after an occurrence of jamming of a sheet medium has been detected by said detecting means.

3. An image forming apparatus as set forth in claim 2, in which said control means comprises a status counter adapted to increment its content in response to a sheet medium supplied by said sheet supply means and decrement its content in response to a sheet medium discharged by said sheet discharging means and in response to an incrementing of said jam counter, said control means being operative to disable said jam counter depending on the content of said status counter.

4. An image forming apparatus as set forth in claim 3, further comprising (e) display means for displaying a numerical value corresponding to the content of said jam counter, and (f) switch means for resetting the content of said jam counter to a predetermined initial state.

5. An image forming apparatus as set forth in claim 1, in which said control means is operative to disable said jam counter until a new sheet medium is discharged by said sheet discharge means after an occurrence of jamming of a sheet medium has been detected by said detecting means.

6. An image forming apparatus as set forth in claim 5, further comprising (e) display means for displaying a numerical value corresponding to the content of said jam counter, and (f) switch means for resetting the content of said jam counter to a predetermined initial state.

7. An image forming apparatus as set forth in claim 1, further comprising (e) display means for displaying a numerical value corresponding to the content of said jam counter, and (f) switch means for resetting the content of said jam counter to a predetermined initial state.

8. An image forming apparatus comprising (a) sheet supply means capable of successively supplying sheet media, (b) image producing means for producing an image on each of the sheet media supplied from said sheet supply means, (c) sheet discharge means for discharging from said image producing means each of the sheet media each having an image produced thereon, (d) detecting means for detecting an occurrence of jamming of a sheet medium between said sheet supply means and said sheet discharge means, (e) jam counter operative to count the number of occurrences of jamming of said sheet medium, and (f) control means which, when an occurrence of jamming of a sheet medium is detected by said detecting means, is operative to active said jam counter after it is confirmed that a new sheet medium is supplied from said sheet supply means.

9. An image forming apparatus as set forth in claim 8, further comprising (g) display means for displaying a numerical value corresponding to the content of said jam counter, and (h) switch means for resetting the content of said jam counter to a predetermined initial state.

10. An image forming apparatus comprising (a) sheet supply means capable of successively supplying sheet media, (b) image producing means for producing an image on each of the sheet media supplied from said sheet supply means, (c) sheet discharge means for discharging from said image producing means each of the sheet media each having an image produced thereon, (d) detecting means for detecting an occurrence of jamming of a sheet medium between said sheet supply means and said sheet discharge means, (e) a jam counter operative to count the number of occurrences of jamming of said sheet medium, and (f) control means which, when an occurrence of jamming of a sheet medium is detected by said detecting means, is operative to activate said jam counter after it is confirmed that a sheet medium is discharged by said sheet discharge means.

11. An image forming apparatus as set forth in claim 10, further comprising (g) display means for displaying a numerical value corresponding to the content of said jam counter, and (h) switch means for resetting the content of said jam counter to a predetermined initial state.

12. An image forming apparatus comprising:

(a) image producing means for transporting a sheet medium along a predetermined sheet transport path and producing an image on the sheet medium, (b) detecting means for detecting an occurrence of jamming of a sheet medium at any location of said predetermined sheet transport path, and comprising a plurality of sensors disposed at different locations, respectively, of said predetermined sheet transport path and responsive to the presence and absence of a sheet medium at said different locations (c) jam counter means operative to count the number of occurrences of jamming of said sheet medium, said jam counter means being activated each time an occurrence of jamming is detected by said detecting means, said counter means comprising a plurality of counters provided in conjunction with said different locations, respectively, of said predetermined sheet transport path;

(d) display means for displaying a numerical value corresponding to the content of said jam counter means, and (e) switch means for resetting the content of said jam counter means to a predetermined initial state.

13. An image forming apparatus as set forth in claim 12, further comprising (f) selecting means for selecting one of said plurality of counters, and (g) display control means (C02/C10) for activating said display means to display a numerical value corresponding to the content of the counter selected by said selecting means.

14. An image forming apparatus as set forth in claim 13, in which said switch means is operative to reset the content of said counter selected by said selecting means.

15. An image forming apparatus comprising:

(a) sheet supply means capable of successively supplying sheet media, (b) image producing means for producing an image on each of the sheet media supplied from said sheet supply means, (c) sheet discharge means for discharging from said image producing means each of the sheet media each having an image produced thereon, (d) detecting means for detecting an occurrence of jamming of a sheet medium between said sheet supply means and said sheet discharge means, (e) a jam counter operative to count the number of occurrences of jamming of said sheet medium, and (f) control means which, when an occurrence of jamming of a sheet medium is detected by said detecting means, is operative to activate said jam counter after it is confirmed that the image forming apparatus is ready for copy state.

16. An image forming apparatus as set forth in claim 15, further comprising:

(g) a memory for storing the occurrences of jamming of a sheet medium detected by the detecting means.

* * * * *